US006232537B1

(12) United States Patent
Kimble

(10) Patent No.: US 6,232,537 B1
(45) Date of Patent: May 15, 2001

(54) PIANO ACTION WITH ARTICULATED JACK

(75) Inventor: Thomas E. Kimble, Cincinnati, OH (US)

(73) Assignee: Baldwin Piano & Organ Company, Mason, OH (US)

( * ) Notice: Subject to any disclaimer, the term of this patent is extended or adjusted under 35 U.S.C. 154(b) by 0 days.

(21) Appl. No.: 09/584,885

(22) Filed: Jun. 1, 2000

(51) Int. Cl.[7] ..... G10C 3/00

(52) U.S. Cl. ..... 84/216; 84/236; 84/237; 84/238; 84/239; 84/241; 84/248; 84/249

(58) Field of Search ..... 84/216, 221, 223, 84/236, 237, 239, 238, 241, 248, 249, 423 R

(56) References Cited

U.S. PATENT DOCUMENTS

| | | | | |
|---|---|---|---|---|
| 321,201 | * | 6/1885 | Fischer | 84/249 |
| 598,367 | * | 2/1898 | Turnbull et al. | 84/249 |
| 657,177 | * | 9/1900 | Nickel | 84/249 |
| 902,439 | * | 10/1908 | Nickel | 84/249 |
| 1,823,142 | | 9/1931 | Hickman . | |
| 2,466,498 | | 4/1949 | Smith . | |
| 2,844,984 | | 7/1958 | Dasenbrook et al. . | |
| 3,479,915 | | 11/1969 | Matsumoto . | |
| 4,633,753 | | 1/1987 | Takahashi . | |
| 4,685,371 | | 8/1987 | Levinson . | |
| 4,856,402 | | 8/1989 | Alexander . | |
| 4,953,433 | | 9/1990 | Fandrich et al. . | |
| 5,123,321 | | 6/1992 | Caught . | |
| 5,239,907 | | 8/1993 | Sugiyama et al. . | |

OTHER PUBLICATIONS

Piano Sewicing; Tuning, and Rebuilding by Arthur A. Reblitz The Vestal Press Ltd. Vectal, NY. 1993.*

"Torsion Spring Technical Information", http://www.acxesspring.com, 2 pages.

"Torsion Springs", http://www.exacto.com, 1 page.

"The Piano Hammer", by Walter Pfeiffer, pp. 62–67 and 77–92.

* cited by examiner

*Primary Examiner*—Shih-Yung Hsieh
(74) *Attorney, Agent, or Firm*—Steven J. Rosen

(57) ABSTRACT

A piano keyboard apparatus has an action assembly that includes a four bar linkage having four pivotably connected bars including a whippen pivotably connected to a repetition lever. An articulated jack has a lower link pivotably connected to an upper link and the lower link is pivotably connected to the whippen.

28 Claims, 3 Drawing Sheets

PIANO ACTION WITH ARTICULATED JACK

BACKGROUND OF THE INVENTION

1. Field of the Invention

The present invention relates to piano action mechanisms having jacks, particularly, for use in grand pianos.

2. Discussion of the Background Art

The piano is a keyboard instrument which allows a performer to play both delicately and softly as well as forcefully and loudly. The action is a responsive mechanism whereby a performer can control tone, volume, sustainable tones, and tone quality. Piano strings are struck by hammers and the action provides an escapement mechanism which allows the hammer to leave a "jack" as it approaches the string. After the hammer is thrown against the string by striking a key which actuates the jack, it is free to bounce back after striking the string. This is necessary for the production of a clear unmuffled tone. Escapement and repetition movements are also important functions of the action and should be reliable and precise.

The conventional action mechanism of a grand piano typically includes a linkage having a whippen with a rear end pivotably attached to a flange on a whippen rail and which is propelled upwardly by a capstan screw fastened to a central portion of a key when the key is depressed. The motion of the whippen is transmitted to an L-shaped jack pivoted to the front end of the whippen and an upper end of the jack passes through an elongated hole of a repetition lever to propel a knuckle attached to a hammer shank upwards such that a hammer is driven toward a string to strike it.

In the conventional action mechanism, the force of a finger depressing a key is transmitted from the key to the whippen, from the whippen to the jack, from the jack to the knuckle of the hammer shank, and the force is finally transformed into an arcuate rotational motion of the hammer for producing a particular sound. With such a mechanism or linkage, a particular touch feeling is obtained in playing the piano.

Escapement disconnects the hammer from control of the key a short distance before the hammer strikes the string and is necessary to allow the hammer to rebound from the string and not be blocked against it. A typical grand piano whippen employs the jack to transmit motion from the key to the hammer. This type of jack is nothing more than a prop-stick under compression, which is yanked out of the system an instant before the hammer strikes the string. Articulated jacks are hinged in the middle and unlike the prop-stick jack which is yanked out of the system at the appropriate moment, the articulated jack simply hinges and collapses, permitting escapement with relatively little friction.

It is highly desirable to have an action that has low friction and high stability during operation and is precise in its operation with little play in its linkage. It is also highly desirable to have an action with better dynamic control and one that causes less player fatigue and that is easier and less expensive to construct and regulate than actions presently available. The action should be more wear-free and stable over the long haul. Note-to-note dynamic response should be more uniform. It is also desirable for the newly designed action to have a whippen with the above mentioned attributes and interchangeability with a standard whippen. Prior art actions have a high amount of friction at the jack and knuckle interface and it is desirable to eliminate this.

SUMMARY OF THE INVENTION

A piano keyboard action assembly includes a four bar linkage having four pivotably connected bars including a whippen pivotably connected to a repetition lever. An articulated jack has a lower link pivotably connected to an upper link and the lower link is pivotably connected to the whippen.

ADVANTAGES OF THE INVENTION

The present invention has several advantages over conventional piano actions and, in particular, grand piano actions. It causes less friction and provides higher stability during operation of the action and has a more precise linkage with little play in the linkage. It eliminates the high amount of friction at the jack and knuckle interface of prior art actions. This makes the action more precise with better dynamic control and simple regulation. Therefore, it provides better note-to-note dynamic response and is more uniform. This also results in less player fatigue. An action of the present invention is easier and less expensive to construct, more resistant to wear, and requires fewer regulation adjustments over time, than actions presently available.

Another advantage of the present invention is it allows a newly designed action to have a whippen with the above mentioned attributes and interchangeability with a standard whippen.

BRIEF DESCRIPTION OF THE DRAWINGS

The novel features believed characteristic of the present invention are set forth and differentiated in the claims. The invention, together with further objects and advantages thereof, is more particularly described in conjunction with the accompanying drawings in which:

DETAILED DESCRIPTION

Figure 1:
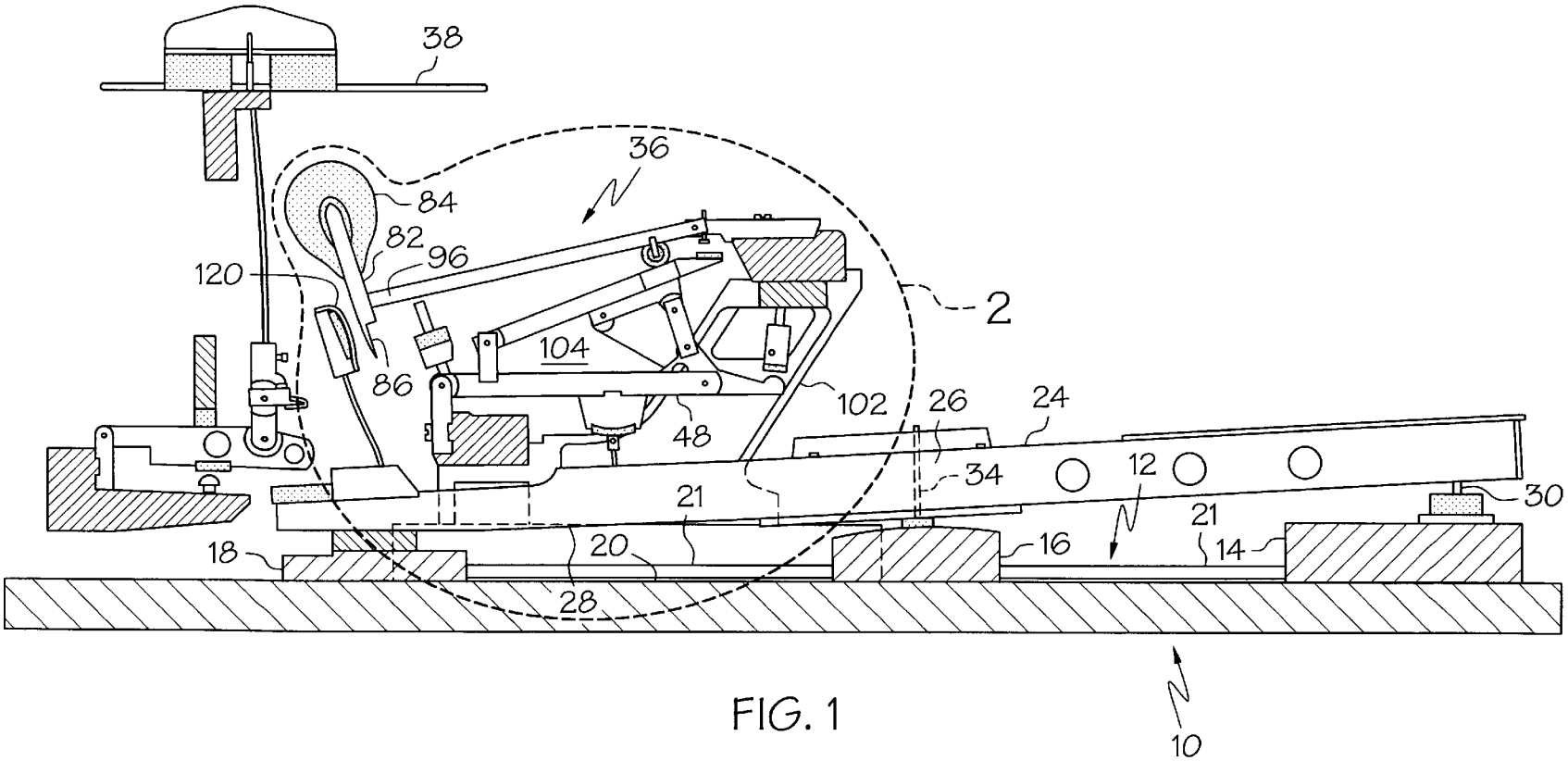
FIG. 1 is a side elevational view illustration of a grand piano action and keyboard apparatus in an exemplary embodiment of the present invention.

Referring now to the drawings in detail wherein identical numerals indicate the same elements throughout the figures. FIG. 1 illustrates an exemplary embodiment of the invention for a piano such as a grand piano 10 having a key frame 12 mounted thereto. The key frame 12 is made up of a front rail 14, a balance rail 16, a back rail 18 and a key bottom 20 for connecting these rails. Slats 21 connect the front rail 14 and the back rail 18 to the balance rail 16. A front pin 30 extends upwardly from the front rail 14 in order to block a key 24 against lateral turning, and a balance pin 34 extends upwardly from the balance rail 16 which holds a middle portion 26 of the key 24 in a vertically turnable fashion.

Figure 2:
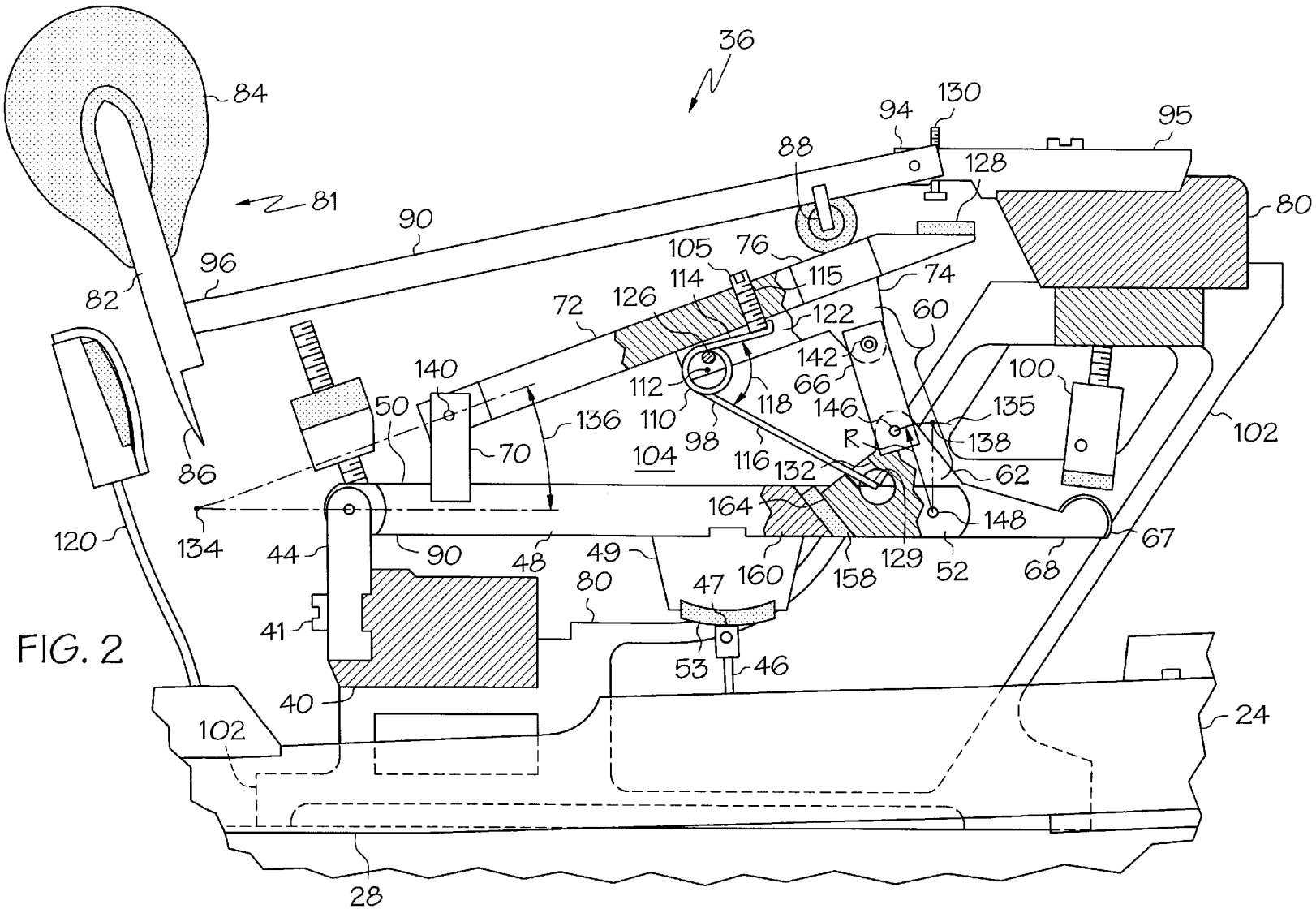
FIG. 2 is an enlarged view illustration of the grand piano action in FIG. 1.
Figure 3:
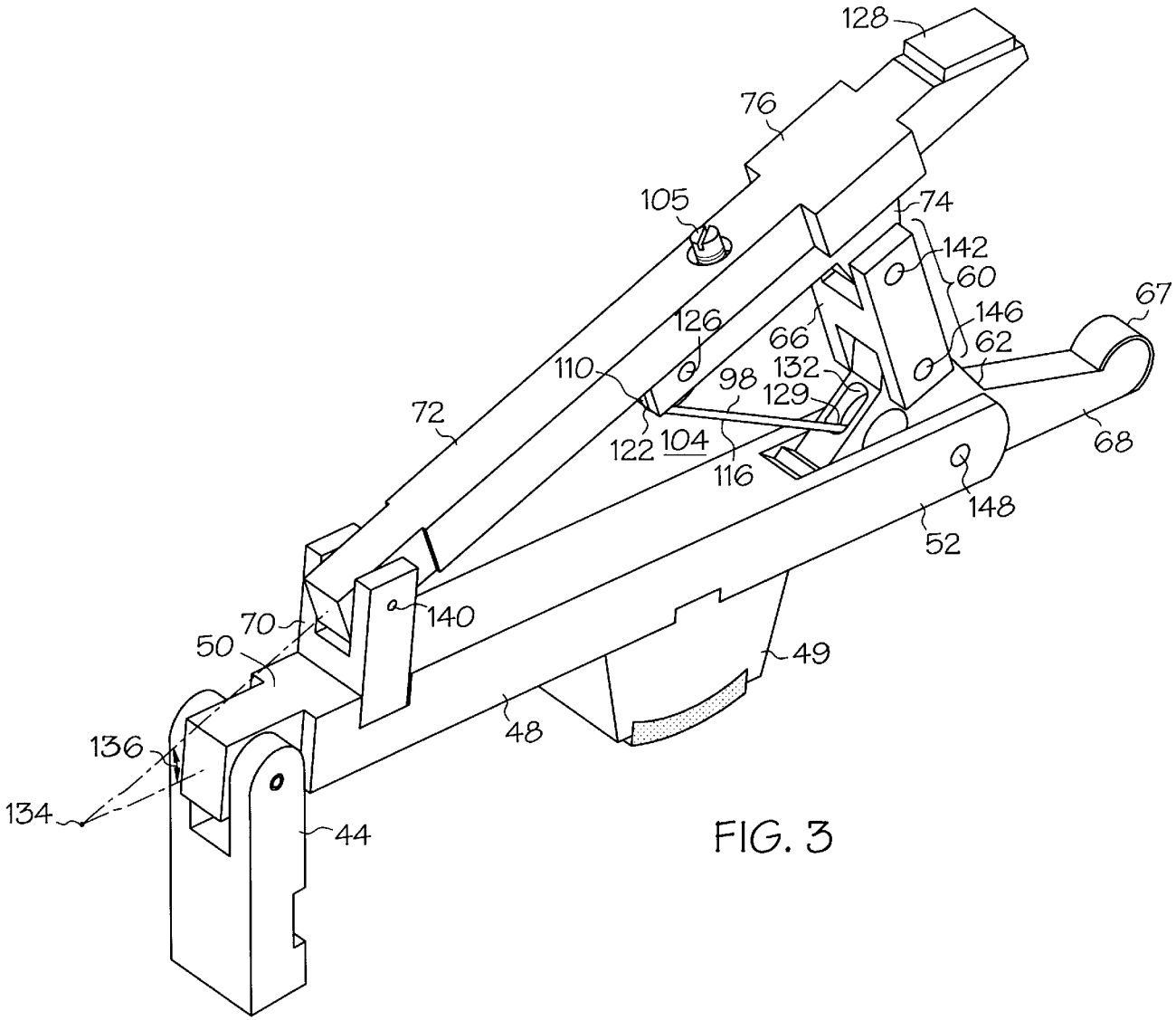
FIG. 3 is a perspective view illustration of a four bar linkage of the grand piano action in FIG. 2.

Further referring to FIGS. 2 and 3, an action assembly 36 (also referred to as an action) is located over a rear end 28 of the key 24 upwardly facing an associated string 38. The action assembly 36 includes a whippen 48 which is pivoted at an aft whippen end 50 to a whippen rail 40 via a whippen flange 44. The whippen flange 44 is removably secured to the whippen rail 40 by a removable attaching means such as a flange screw 41, in the exemplary embodiment illustrated herein, or suitable equivalent so that the action assembly 36 may be easily replaced as well as retrofitted to other pianos. The whippen rail 40 is impelled upwards by a capstan screw 46, which is a metal screw with a smooth upper face 47 mounted on and extending upwardly from the key 24, when the key 24 is depressed. The capstan screw 46 is located directly beneath a depending appendage 49 of the whippen 48 having a felt covered bottom 53. An articulated jack 60 has a lower link 62 pivotably connected to an upper link 66. The lower link 62 is pivotably connected to a free end 52 of the whippen 48.

A repetition lever 72 is pivotably connected to the top end of a repetition lever flange 70 mounted on the whippen 48. The upper link 66 of the jack 60 is pivotably connected to an underside extension 74 of the repetition lever 72. A hammer shank 90 is pivoted at a first shank end 94 to a hammer shank flange 95 that is secured by a screw to a shank flange rail 80 and has a knuckle 88 located depending from said shank above a lever pad 76 on the repetition lever 72. A hammer 81 includes a hammer felt 84 wrapped around a top portion a hammer wood molding 82 which is attached to a free second shank end 96 of the hammer shank 90.

The action assembly 36 includes a multi-bar closed linkage having a plurality of serially pivotably connected bars preferably in the form of a four bar linkage 104 having four pivotably connected bars. The four bar linkage 104 includes in serial relationship; the whippen 48 pivotably connected to the repetition lever 72 by a pinned clevis first joint 140; the repetition lever 72 pivotably connected to the upper link 66 by a pinned clevis second joint 142; the upper link 66 pivotably connected to the lower link 62 by a pinned clevis third joint 146; and the lower link 62 pivotably connected to the whippen 48 by a pinned clevis fourth joint 148. The four bar linkage 104 increases stability and preciseness of the action and reduces play in the linkages as compared to conventional whippens. The four bar linkage design also reduces friction in the whippen assembly during escapement.

A repetition spring 98, exemplified herein as a torsional spring, is disposed between the whippen 48 and the repetition lever 72 for rotationally biasing the whippen 48 and the repetition lever 72 apart and spring biasing and urging the jack 60 and the repetition lever 72 on return movement. The repetition spring 98 has a coil 110 having a center 112 and to which upper and lower spring arms 114 and 116, respectively, are attached and define an open angle 118 between them. The coil 110 is partially retained in a slot 122 in the underside extension 74 of the repetition lever 72 by a spring pin 126 through the extension and passing inside the coil. The upper spring arm 114 is disposed within the slot 122 and engages a spring tension adjusting screw 105 adjustably threaded in a threaded hole 115 through the repetition lever 72 to the slot. The adjusting screw 105 is used to adjust the tension in the spring and provides a spring tension adjusting means for adjusting biasing force in the repetition spring 98 that rotationally biases the whippen 48 and the repetition lever 72 apart. A lower arm end 129 of the lower spring arm 116 engages the lower link 62 of the articulated jack 60 in an aperture 132 in the lower link.

The whippen rail 40 and the shank flange rail 80 are both disposed on an action bracket 102 on the key frame 12. A regulating button 100 adjustably screwed into the shank flange rail 80 is used to engage a rounded end 67 of a lever arm 68 (also referred to as a jack tender) of the lower link 62 to limit the pivotal movement of the lower link. The aperture 132 is disposed in the lower link 62 such that the lower link operates as a rocker pivoted about the pinned clevis fourth joint 148 by the force of the spring acting on the lower link at the aperture and limited in its pivotal movement by the rounded end 67 of the lever arm 68 engaging the regulating button 100.

When the key is depressed, the jack 60 is straight and moves upwards with the repetition lever 72 and the knuckle 88. During this movement, the lever arm 68 of the lower link 62 of the jack 60 touches the regulating button 100 causing the upper link 66 and the lower link 62 to pivot with respect to each other and disengage the repetition lever 72 from the knuckle 88. This disengagement is referred to as "escapement." The knuckle 88, the hammer shank 90, and the hammer felt 84 continue their upward movement until the hammer felt 84 strikes the associated string 38.

The third joint 146 pivots about the fourth joint 148 along an arc 135 having a radius R on the lower link 62 extending between the third and fourth joints. A top center 138 of the third joint 146 is a position where the radius R is normal to the whippen 48. The second joint 142, third joint 146, and the fourth joint 148 are linearly aligned such that the third joint 146 is in a position referred to as left of center such that the upper link 66 and the lower link 62 are linearly aligned and locked up. When the key is at rest before being depressed, the third joint 146 is located left of center which is between an apex 134 of an acute angle 136 between the whippen 48 and the repetition lever 72. The position of the third joint 146 is set by a felt covered angled stop 158 in a whippen slot 160 contacting an angled surface 164 on the lower link 62. When the key 24 is depressed, a force is transmitted through the locked up articulated jack 60 to the repetition lever 72 impelling the hammer shank 90 to rotate upwards until it reaches a point where a top end 128 of the repetition lever 72 contacts a stop screw 130 adjustably threaded through the hammer shank flange 95 and that determines the point at which the repetition lever can travel no farther upwards. The stop screw 130 stops the rotation of the repetition lever 72 before the hammer 81 strikes the string 38. The point of escapement is set by the regulating button 100 being adjusted so it makes the lower link 62 rotate over center and pivot downward pushing the third joint 146 over center causing the jack and its two upper and lower links to collapse and no longer be locked up.

After the hammer 81 has struck the string 38 it rebounds and rotates downwardly until a hammer tail 86 of the hammer 81 is caught by a backcheck 120 mounted to the key frame 12. While the key 24 is depressed all the way to the stop position and the hammer 81 is caught by the backcheck 120, the spring 98 is poised to reset the lower link 62 of the jack 60. When the key 24 is released the hammer tail 86 is released and the repetition lever 72 is impelled upwards due to the force in the spring 98. The lower link 62 is rotated back to the reset position where the second joint 142, third joint 146, and the fourth joint 148 are aligned and the upper link 66 and the lower link 62 are linearly aligned and locked up such that the jack 60 functions as a solid column. At this point, the key is fully released and is ready to be depressed or struck again.

While the preferred embodiment of our invention has been described fully, in order to explain its principles, it is understood that various modifications or alterations may be made to the preferred embodiment without departing from the scope of the invention as set forth in the appended claims.

What is claimed is:

1. A piano keyboard action assembly comprising:

a multi-bar linkage further comprising;

a whippen pivotably connected to a repetition lever, an articulated jack having a lower link pivotably connected to an upper link, said whippen pivotably connected to said lower link, said repetition lever pivoted to said whippen, said upper link pivotably connected to said repetition lever, a torsional spring disposed between said whippen and said repetition lever so as to rotationally bias said whippen and said repetition lever apart, and said torsional spring comprising a coil having upper and lower spring arms attached to said coil and defining an open angle therebetween wherein said upper spring arm engages said repetition lever and lower said spring arm engages said lower link.

2. A piano keyboard apparatus comprising:

an action assembly having a four bar linkage, said four bar linkage further comprising;

a whippen pivotably connected to a repetition lever, an articulated jack having a lower link pivotably connected to an upper link, said whippen pivotably connected to said lower link, said repetition lever pivoted to said whippen, said upper link pivotably connected to said repetition lever, a torsional spring disposed between said whippen and said repetition lever so as to rotationally bias said whippen and said repetition lever apart, and said torsional spring comprising a coil having upper and lower spring arms attached to said coil and defining an open angle therebetween wherein said upper spring arm engages said repetition lever and said lower spring arm engages said lower link.

3. An apparatus as claimed in claim 2, wherein said torsional spring is disposed between said whippen and said repetition lever so as to rotationally bias said whippen and said repetition lever apart.

4. An apparatus as claimed in claim 3, further comprising a spring tension adjusting means for adjusting biasing force in said repetition spring that rotationally biases said whippen and said repetition lever apart.

5. An apparatus as claimed in claim 4, wherein said repetition spring is a torsional spring comprising a coil having upper and lower spring arms attached to said coil and defining an open angle therebetween.

6. A piano keyboard apparatus comprising:

an action assembly having a four bar linkage, said four bar linkage further comprising;

a whippen pivotably connected to a repetition lever, an articulated jack having a lower link pivotably connected to an upper link, said whippen pivotably connected to said lower link, said repetition lever pivoted to said whippen, said upper link pivotably connected to said repetition lever, a torsional spring disposed between said whippen and said repetition lever so as to rotationally bias said whippen and said repetition lever apart, a spring tension adjusting means for adjusting biasing force in said torsional spring, said torsional spring comprising a coil having upper and lower spring arms attached to said coil and defining an open angle therebetween, a slot in an underside extension of said repetition lever, said coil partially retained in said slot, a spring pin disposed through said extension and passing inside said coil, and said upper spring arm disposed in said slot and engaging spring tension adjusting means.

7. An apparatus as claimed in claim 6, wherein said spring tension adjusting means is a spring tension adjusting screw adjustably threaded in a threaded hole through said repetition lever to said slot.

8. An apparatus as claimed in claim 2, wherein:

said whippen is pivotably connected to said repetition lever by a pinned clevis first joint, said repetition lever is pivotably connected to said upper link by a pinned clevis second joint, said upper link is pivotably connected to said lower link by a pinned clevis third joint and said lower link is pivotably connected to said whippen by a pinned clevis fourth joint.

9. An apparatus as claimed in claim 8, further comprising a repetition spring disposed between said whippen and said repetition lever so as to rotationally bias said whippen and said repetition lever apart.

10. An apparatus as claimed in claim 9, further comprising a spring tension adjusting means for adjusting biasing force in said repetition spring that rotationally biases said whippen and said repetition lever apart.

11. An apparatus as claimed in claim 10, wherein said repetition spring is a torsional spring comprising a coil having a upper and lower spring arms attached to said coil and defining an open angle therebetween.

12. A piano keyboard apparatus comprising:

an action assembly having a four bar linkage, said four bar linkage further comprising;

a whippen pivotably connected to a repetition lever, an articulated jack having a lower link pivotably connected to an upper link, said whippen pivotably connected to said lower link, said repetition lever pivoted to said whippen, said upper link pivotably connected to said repetition lever, said whippen is pivotably connected to said repetition lever by a pinned clevis first joint, said repetition lever is pivotably connected to said upper link by a pinned clevis second joint, said upper link is pivotably connected to said lower link by a pinned clevis third joint and said lower link is pivotably connected to said whippen by a pinned clevis fourth joint, a torsional spring disposed between said whippen and said repetition lever so as to rotationally bias said whippen and said repetition lever apart, a spring tension adjusting means for adjusting biasing force in said torsional spring, said torsional spring comprising a coil having upper and lower spring arms attached to said coil and defining an open angle therebetween, and a slot in an underside extension of said repetition lever, said coil partially retained in said slot, a spring pin disposed through said extension and passing inside said coil, and said upper spring arm disposed in said slot and engaging spring tension adjusting means.

13. An apparatus as claimed in claim 12, wherein said spring tension adjusting means is a spring tension adjusting screw adjustably threaded in a threaded hole through said repetition lever to said slot.

14. An apparatus as claimed in claim 13, wherein said lower spring arm has a lower arm end disposed in an aperture in said lower link and said lower link has a lever arm extending away from said aperture.

15. An apparatus as claimed in claim 14, further comprising a felt covered angled stop in a whippen slot positioned to contact an angled surface on said lower link.

16. An apparatus as claimed in claim 15, further comprising:

a hammer shank pivoted at a first shank end to a hammer shank flange secured to a shank flange rail, a knuckle depending from said hammer shank and located above a lever pad on said repetition lever, and a hammer including a hammer felt wrapped around a hammer wood molding that is attached to a free second shank end of said hammer shank.

17. An apparatus as claimed in claim 16, further comprising a stop screw adjustably threaded through said the hammer shank flange positioned above a top end of said repetition lever.

18. An apparatus as claimed in claim 17, further comprising:

an aft whippen end of said whippen, said aft whippen end pivoted to a whippen rail via a whippen flange, and an action bracket supporting said whippen rail and said shank flange rail.

19. An apparatus as claimed in claim 18, wherein said action assembly is located over a piano key and said apparatus further includes, a capstan screw mounted on and extending upwardly from said key and located directly beneath a depending appendage of said whippen, and a felt covered bottom on said appendage.

20. An apparatus as claimed in claim 8, wherein said action assembly is located over a piano key and when said piano key is at rest:

said second, third, and fourth joints are linearly aligned and said upper and lower links are linearly aligned and locked up.

21. An apparatus as claimed in claim 2, further comprising a whippen flange pivotably connected to an aft whippen end of said whippen.

22. An apparatus as claimed in claim 21, further comprising a repetition spring disposed between said whippen and said repetition lever so as to rotationally bias said whippen and said repetition lever apart.

23. An apparatus as claimed in claim 22, further comprising a spring tension adjusting means for adjusting biasing force in said repetition spring that rotationally biases said whippen and said repetition lever apart.

24. An apparatus as claimed in claim 23, wherein said repetition spring is a torsional spring comprising a coil having upper and lower spring arms attached to said coil and defining an open angle therebetween.

25. A piano keyboard apparatus comprising:

an action assembly having a four bar linkage, said four bar linkage further comprising;

a whippen pivotably connected to a repetition lever, an articulated jack having a lower link pivotably connected to an upper link, said whippen pivotably connected to said lower link, said repetition lever pivoted to said whippen, said upper link pivotably connected to said repetition lever, a whippen flange pivotably connected to an aft whippen end of said whippen, a repetition spring disposed between said whippen and said repetition lever so as to rotationally bias said whippen and said repetition lever apart, a spring tension adjusting means for adjusting biasing force in said repetition spring that rotationally biases said whippen and said repetition lever apart, said repetition spring is a torsional spring comprising a coil having a upper and lower spring arms attached to said coil and defining an open angle therebetween, a slot in an underside extension of said repetition lever, said coil partially retained in said slot, a spring pin disposed through said extension and passing inside said coil, and said upper spring arm disposed in said slot and engaging spring tension adjusting means.

26. An apparatus as claimed in claim 25, wherein said spring tension adjusting means is a spring tension adjusting screw adjustably threaded in a threaded hole through said repetition lever to said slot.

27. A piano keyboard action assembly comprising:

a multi-bar linkage further comprising;

a whippen pivotably connected to a repetition lever, an articulated jack having a lower link pivotably connected to an upper link, said whippen pivotably connected to said lower link, said repetition lever pivoted to said whippen, said upper link pivotably connected to said repetition lever, and a torsional spring disposed between said whippen and said repetition lever so as to rotationally bias said whippen and said repetition lever apart, and said torsional spring comprising a coil having upper and lower spring arms attached to said coil and defining an open angle therebetween wherein said upper spring arm engages said repetition lever and said lower spring arm engages said lower link.

28. A piano keyboard apparatus as claimed in claim 27 wherein said action assembly includes:

a four bar linkage comprising said whippen pivotably connected to said repetition lever, said lower link pivotably connected to said upper link, said whippen pivotably connected to said lower link, said repetition lever pivoted to said whippen, and said upper link pivotably connected to said repetition lever.

* * * * *